US007621608B2

(12) United States Patent
Kusunoki et al.

(10) Patent No.: US 7,621,608 B2
(45) Date of Patent: Nov. 24, 2009

(54) IMAGE FORMING APPARATUS HAVING IMPROVED CAPABILITY FOR MAINTAINING INK DELIVERY

(75) Inventors: Masanori Kusunoki, Kanagawa (JP); Noriyasu Takeuchi, Kanagawa (JP); Kunihiro Yamanaka, Kanagawa (JP); Tamotsu Aruga, Kanagawa (JP); Hiroshi Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 451 days.

(21) Appl. No.: 11/450,595

(22) Filed: Jun. 8, 2006

(65) Prior Publication Data

US 2006/0279603 A1 Dec. 14, 2006

(30) Foreign Application Priority Data

Jun. 10, 2005 (JP) ..... 2005-170495

(51) Int. Cl.
*B41J 29/38* (2006.01)
*B41J 2/165* (2006.01)

(52) U.S. Cl. ..... 347/5; 347/29; 347/30; 347/32

(58) Field of Classification Search ..... 347/5, 347/6, 7, 9, 20, 29, 30, 32, 36, 85, 86, 89, 347/95

See application file for complete search history.

(56) References Cited

U.S. PATENT DOCUMENTS

| | | | |
|---|---|---|---|
| 6,729,716 | B2 | 5/2004 | Eguchi et al. |
| 2003/0222929 | A1 * | 12/2003 | Horigome |
| 2004/0207671 | A1 | 10/2004 | Kusunoki et al. |

FOREIGN PATENT DOCUMENTS

| | | |
|---|---|---|
| JP | 11-263021 | 9/1999 |
| JP | 2003-341146 | 12/2003 |
| JP | 2005-170035 | 6/2005 |

* cited by examiner

*Primary Examiner*—Shih-Wen Hsieh
(74) *Attorney, Agent, or Firm*—Cooper & Dunham, LLP

(57) ABSTRACT

An image forming apparatus having a recording head for discharging an ink includes a fuel cell unit and a water supply unit. The fuel cell unit generates power for the image forming apparatus and water when the power is generated in the fuel cell unit. The water supply unit supplies the water, generated by the fuel cell unit, to an ink accumulation area in the image forming apparatus.

20 Claims, 7 Drawing Sheets

IMAGE FORMING APPARATUS HAVING IMPROVED CAPABILITY FOR MAINTAINING INK DELIVERY

TECHNICAL FIELD

The present disclosure generally relates to an image forming apparatus, and more particularly to an image forming apparatus using fuel cell as power source and water from the fuel cell as water source for cleaning a recording head.

BACKGROUND

Generally, when an inkjet recording apparatus repeatedly conducts printing operations, foreign materials such as paper powder, dust, viscosity-increased ink, and ink droplet may adhere on a nozzle of a recording head, by which the nozzle of the recording head may be affected, and a deterioration of image quality may happen due to a malfunction of recording head such as nozzle blocking and irregular discharge caused by an adhesion of foreign materials.

In order to cope with such drawbacks, a capping unit and a negative pressure generator may be used, for example. The negative pressure generator sucks ink from the nozzle while the nozzle is capped by the capping unit.

Furthermore, a wiping unit may be used to cope with such drawbacks, for example, wherein the wiping unit scrapes and removes foreign materials from the nozzle.

In addition, a dummy discharge can be conducted before re-starting printing after leaving the nozzle without discharging fresh ink for some time. In the dummy discharge, fresh ink is discharged from the nozzle without actual printing operation to remove viscosity-increased ink on the nozzle.

Furthermore, such inkjet recording apparatus includes a waste ink processing unit for storing waste ink used in ink suctioning or dummy discharge operation, and the waste ink processing unit includes an absorber for efficient storing of waste ink.

However, when the nozzle is cleaned by the wiping unit having wiping blade, viscosity-increased ink may stick on the wiping blade. When another cleaning is conducted by such wiping blade having the ink stuck thereon, such ink may move onto the nozzle, or intrude inside of the nozzle, by which discharge-ability of the nozzle may deteriorate.

Furthermore, when viscosity-increased waste ink in the waste ink processing unit sticks, such ink may not be absorbed by the absorber in the waste ink processing unit, and waste ink may spillover from the waste ink processing unit.

Furthermore, after the ink suctioning is conducted on the nozzle, ink remaining on the capping unit may increase its viscosity, and may be dried. If such capping unit is used for capping the nozzle for a long period of time, the viscosity-increased ink may become an absorbent, which absorbs water or moisture from the nozzle. If such condition occurs, the nozzle may not be refreshed even if the dummy discharge is conducted.

SUMMARY

The present disclosure relates to an image forming apparatus having a recording head for discharging an ink, a fuel cell unit, and a water supply unit. The fuel cell unit generates power for the image forming apparatus, and water when the power is generated in the fuel cell unit. The water supply unit supplies the water, generated by the fuel cell unit, to an ink accumulation area in the image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Figure 1:
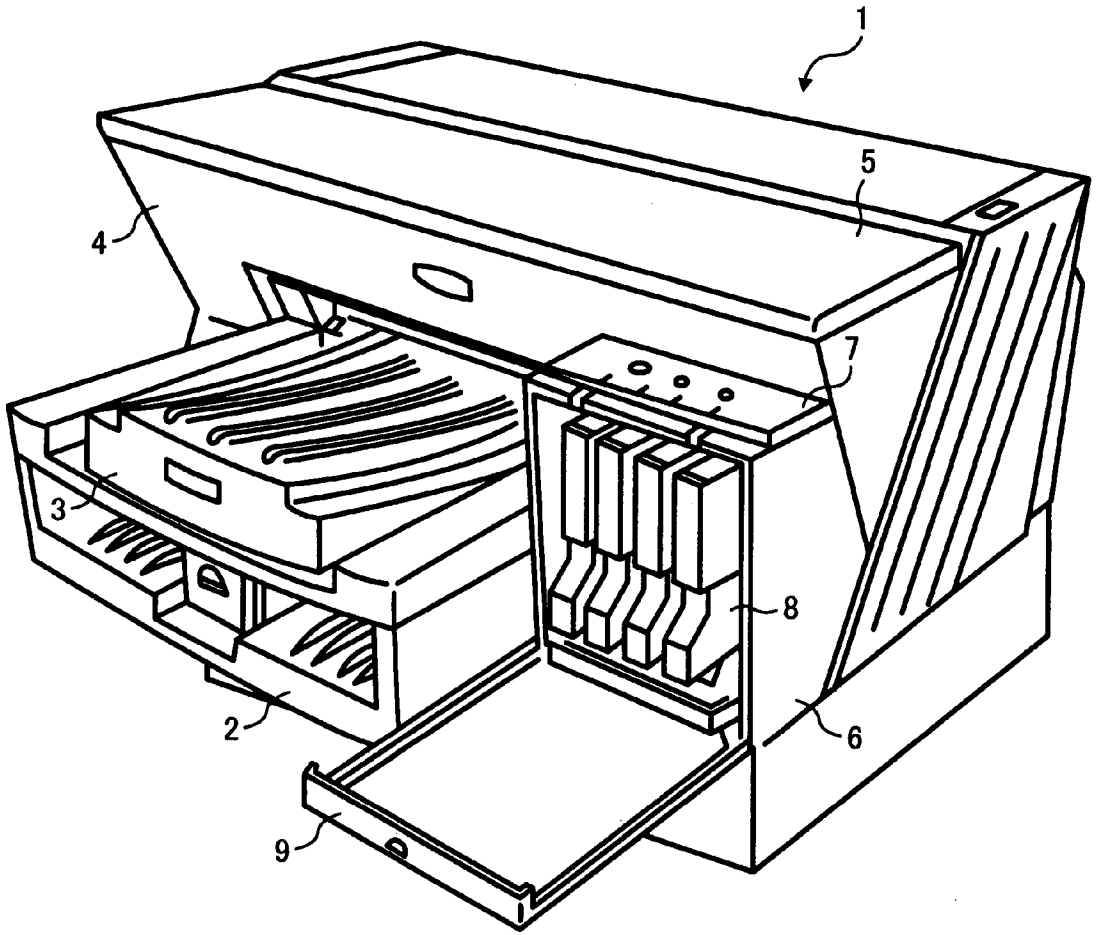
FIG. 1 is a perspective view of an image forming apparatus, having a fuel cell unit, according to an exemplary embodiment.

In describing exemplary embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Figure 2:
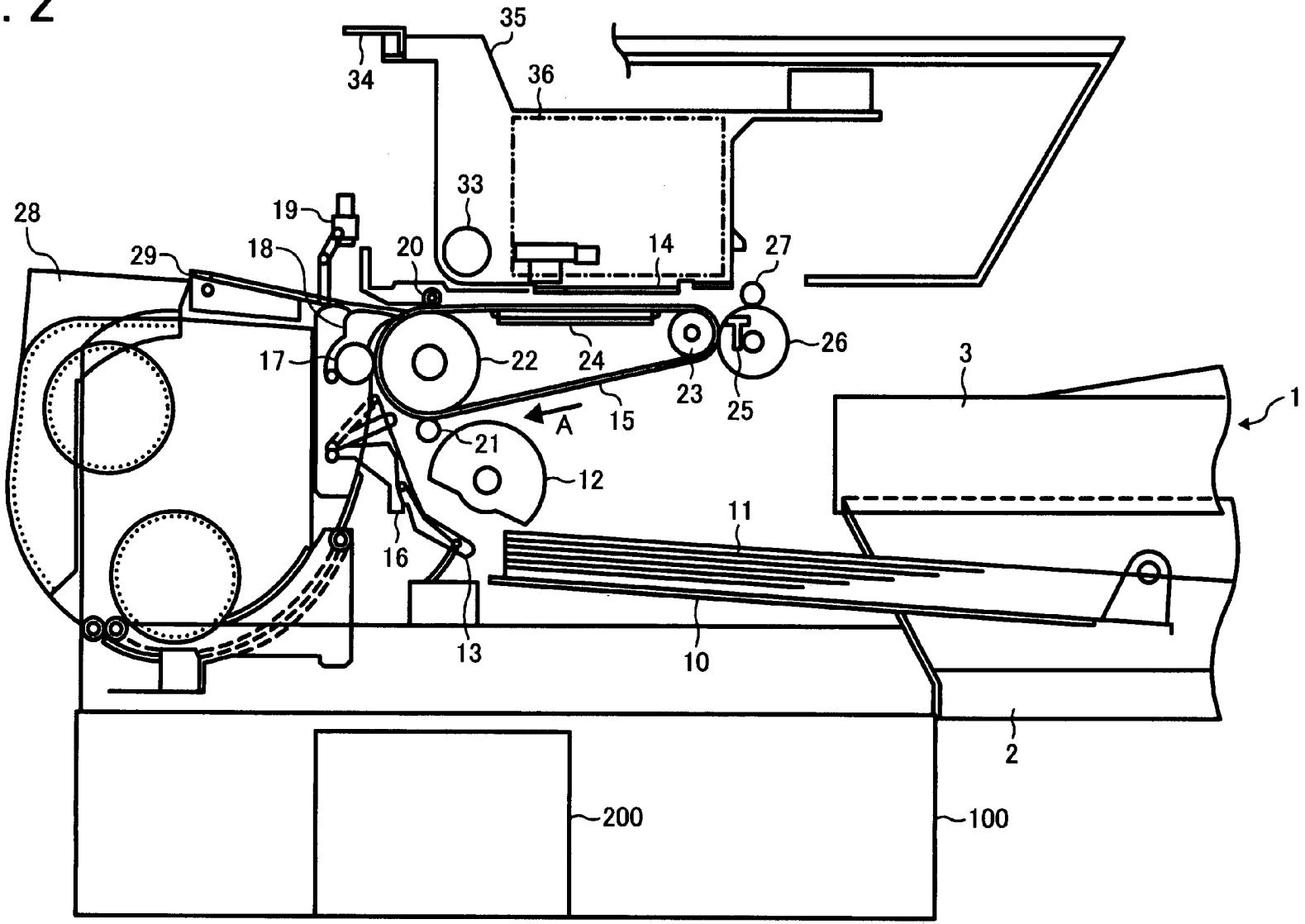
FIG. 2 is a schematic cross sectional view of an image forming apparatus of FIG. 1.

Referring now to the drawings, wherein like reference numerals designate identical or corresponding parts throughout the several views, an image forming apparatus according to an exemplary embodiment is described with particular reference to FIGS. 1 and 2.

FIG. 1 is a perspective view of an image forming apparatus 1 according to an exemplary embodiment, and FIG. 2 is a schematic cross sectional view of the image forming apparatus 1.

As shown in FIG. 1, the image forming apparatus 1 includes a sheet feed tray 2, an ejection tray 3, an apparatus body 5, a cartridge section 6, and an operating unit 7.

The sheet feed tray 2 stacks recording sheets and feeds the recording sheets to the apparatus body 5. The ejection tray 3 receives the recording sheets after images are printed on the recording sheets in the apparatus body 5.

The cartridge section 6 is provided on one end of a front face 4 of the apparatus body 5, wherein the cartridge section 6 may protrude from the front face 4 as shown in FIG. 1.

As shown in FIG. 1, the operating unit 7 including operation keys and display is provided on a top face of the cartridge section 6.

The cartridge section 6 includes an ink cartridge 8 and a front cover 9. The ink cartridge 8, detachable to the cartridge section 6, includes a tank to store recording liquid such as ink, and the front cover 9 is openable with respect to the cartridge section 6.

Hereinafter, the recording liquid is referred as recording ink or ink, as required. The recording liquid includes inks having a variety of viscosity levels (i.e., from low to high viscosity), for example.

As shown in FIG. 2, the image forming apparatus 1 includes a fuel cell unit 100 and a water supply unit 200 under the apparatus body 5.

The fuel cell unit 100 supplies electric power to the image forming apparatus 1 and the water supply unit 200 of the fuel cell unit 100 supplies water to a refreshing unit 42 (to be described) and other section, as required.

The image forming apparatus 1 includes the fuel cell unit 100 as a power source and as a water supply source.

The fuel cell unit 100 can be used in several ways, for example, as main power source, auxiliary power source for a commercial power source, and dual power source (i.e., using commercial power source and fuel cell interchangeably).

The fuel cell unit 100 can be provided in any part of the image forming apparatus 1. However, the fuel cell unit 100 is preferably provided in an area, which is remote from an ink area such as ink cartridge 8, because the ink may be affected by heat, which is generated when electricity is generated by the fuel cell unit 100.

For example, the fuel cell unit 100 can be provided in a lower portion of the image forming apparatus 1 as shown in FIG. 2, or upper portion of the image forming apparatus 1.

Hereinafter, a printing operation in the image forming apparatus 1 is explained with reference to FIGS. 2 and 3.

As shown in FIG. 2, a sheet feed section includes a sheet stack 10, a sheet 11, a sheet feed roller 12 shaped in half-moon, and a separation pad 13 made of material having a larger friction coefficient. The separation pad 13 is biased toward the sheet feed roller 12.

As shown in FIG. 2, a plurality of sheets (i.e., sheet 11) is stacked on the sheet stack 10 of the sheet feed tray 2.

The sheet feed roller 12 and the separation pad 13, which face each other, are used to feed sheets one by one to a transport section from the sheet stack 10.

The transport section includes a transport belt 15, a guide 16, a counter roller 17, a transport guide 18, a press member 19, a pressure roller 20, and a charge roller 21.

The transport section transports the sheet 11 from the sheet feed section to a recording section.

The sheet 11 is fed from the sheet feed section with a guide effect of the guide 16, and then the sheet 11 is sandwiched by the counter roller 17 and the transport belt 15.

The transport belt 15 is charged by the charge roller 21 so that a surface of transport belt 15 can electro-statically adhere the sheet 11 thereon and transport the sheet 11 to the recording section.

The transport guide 18 is used to change a transport direction of the sheet 11 with a 90-degree so that the sheet 11 can follow a traveling direction of the transport belt 15.

The pressure roller 20 is used to bias the sheet 11 toward the surface of the transport belt 15, wherein the pressure roller 20 is biased toward the transport belt 15 by the press member 19.

As shown in FIG. 2, the transport belt 15 is an endless type belt and is extended by a transport roller 22 and a tension roller 23. The transport belt 15 travels in a direction shown by an arrow A in FIG. 2.

The charge roller 21 contacts the transport belt 15 and is rotated by with a traveling of the transport belt 15.

As shown in FIG. 2, a guide member 24 is provided on an inner face of the transport belt 15, wherein the guide member 24 faces a printing area of a recording head 14.

An upper face of the guide member 24 is protruded toward the recording head 14 from a tangent line defined by the transport roller 22 and tension roller 23.

Accordingly, the transport belt 15 is pushed toward an upper direction by the upper face of the guide member 24 at the printing area, and thereby a planarity of the transport belt 15 at the printing area can be maintained with a higher precision.

After a printing operation is conducted to the sheet 11 by the recording head 14, the sheet 11 is ejected to the ejection tray 3 by an ejection unit.

The ejection unit includes a separation claw 25, and ejection rollers 26 and 27. The separation claw 25 separates the sheet 11 from the transport belt 15.

The ejection tray 3 is provided under the ejection roller 26. A space from the ejection rollers 26 and 27 to the ejection tray 3 is set in a relatively larger volume so that the ejection tray 3 can stack a larger number of sheets.

The image forming apparatus 1 can further includes a sheet-inverting unit 28 on a back side of the apparatus body 5 as shown in FIG. 2, wherein the sheet-inverting unit 28 is detachable to the apparatus body 5.

The sheet-inverting unit 28 receives the sheet 11 from the transport belt 15 when the transport belt 15 travels in a direction opposite to the direction shown by an arrow A, and inverts faces of the sheet 11. Then the sheet-inverting unit 28 feeds the face-inverted sheet 11 to the space formed between the counter roller 17 and the transport belt 15.

Furthermore, a manual sheet feeder 29 can be provided on an upper face of the sheet-inverting unit 28.

Figure 3:
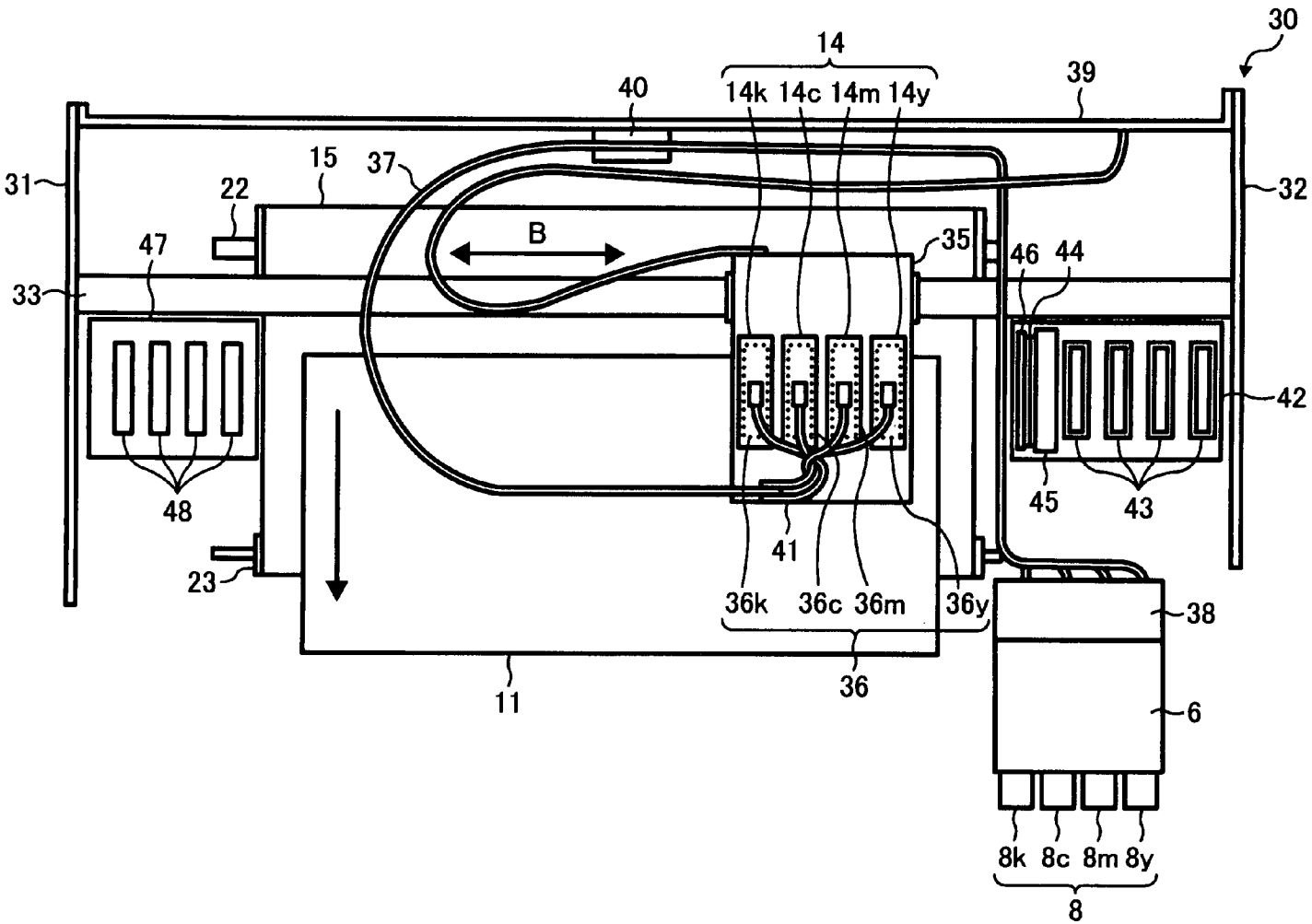
FIG. 3 is a plan view of a recording section of an image forming apparatus of FIG. 1.

FIG. 3 is a plan view of a recording section of the image forming apparatus 1.

As shown in FIG. 3, the recording section includes a frame 30, side plates 31 and 32, a guide rod 33, a stay 34, and a carriage 35.

The frame 30 has two side plates 31 and 32, and the guide rod 33 is extended between the side plates 31 and 32.

The stay 34 (FIG. 2) and the guide rod 33 support the carriage 35 so that the carriage 35 can slidably move in a main scanning direction of the sheet 11.

The carriage 35 can be moved bi-directionally shown by an arrow B in FIG. 3 by a motor (not shown).

The carriage 35 includes the recording head 14. The recording head 14 includes at least one recording head. For example, the recording head 14 includes an inkjet head, which can discharge droplets of recording ink 8 (e.g., ink droplet).

The recording head 14 includes a plurality of nozzles to discharge droplets of recording ink 8 (e.g., ink droplet) toward the sheet 11. The nozzles are typically provided as a nozzle-line, and nozzles in the nozzle-line are typically arranged in a direction perpendicular to the main scanning direction.

In the example shown in FIG. 3, the recording head 14 includes a recording head 14*y* for discharging recording ink in yellow (Y) droplet, a recording head 14*m* for discharging recording ink in magenta (M) droplet, a recording head 14*c* for discharging recording ink in cyan (C) droplet, and a recording head 14*k* for discharging recording ink in black (K) droplet. However, it should be understood that the recording head 14 can include any number of recording heads depending on a number of colors of recording ink used for the image forming apparatus 1. In addition, the recording heads 14 can includes one or more nozzle-lines in the recording head 14.

Because the recording heads 14*y*, 14*m*, 14*c*, and 14*k* take a similar configuration one another, the recording head 14 is described generically in the following explanation.

The recording head 14 can include any type of nozzle. For example, a piezoelectric actuator using piezoelectric element, a thermal actuator using electricity/heat conversion element (e.g., heater), which causes phase change such as film boiling of liquid, a memory metal actuator using phase change of metal caused by temperature change, and an electrostatic actuator using electrostatic power can be used for the nozzle.

The carriage 35 includes a sub-tank 36 having sub-tanks 36*y*, 36*m*, 36*c*, and 36*k* to supply recording ink in different colors to the recording head 14.

The sub-tank 36 is connected to the ink cartridge 8 (i.e., ink cartridge 8*y*, 8*m*, 8*c*, and 8*k*) via a liquid supply tube 37 so that recording ink can be supplied from the ink cartridge 8 to the sub-tank 36.

As shown in FIGS. 1 and 3, the ink cartridge 8 is installed in the cartridge section 6, wherein the cartridge section 6 includes a supply pump unit 38 used for feeding the recording ink from the ink cartridge 8 to the sub-tank 36.

The liquid supply tube 37, which is routed from the cartridge section 6 to the sub-tank 36, is held by a holder 40 on a back plate 39 of the frame 30, and held by a rib 41 in the carriage 35.

As shown in FIG. 3, a refreshing unit 42 is provided on one end of the apparatus body 5 (e.g., near the side plate 32), wherein the refreshing unit 42 is used to maintain nozzle condition of the recording head 14 and to refresh the nozzle of the recording head 14.

The refreshing unit 42 includes a capping member 43, a wiping blade 44, a first dummy discharge receiver 45, a wiper cleaner 46, and a cleaning roller (not shown).

The capping member 43 is used for capping a nozzle face of the recording head 14. The wiping blade 44 wipes the nozzle face.

The first dummy discharge receiver 45 is used for receiving droplets when a dummy discharging operation is conducted, wherein the dummy discharging operation is conducted by discharging fresh ink from the nozzle without actual printing, by which viscosity-increased ink on the nozzle may be removed.

The wiper cleaner 46 wipes ink adhered on the wiping blade 44. The cleaning roller (not shown) pushes the wiping blade 44 to the wiper cleaner 46 when to clean the wiping blade 44 with the wiper cleaner 46.

As also shown in FIG. 3, a second dummy discharge receiver 47 is provided on another end of the apparatus body 5 (e.g., near the side plate 31).

The second dummy discharge receiver 47 is used for receiving droplets when a dummy discharging operation from the nozzle is conducted during actual printing. During actual printing, the recording ink may increase its viscosity, and thereby such a dummy discharging may be conducted to discharge viscosity-increased ink from the nozzle to the second dummy discharge receiver 47. The second dummy discharge receiver 47 includes an opening 48, which is aligned to a nozzle-line direction of the recording head 14.

In the image forming apparatus 1, the sheet feed tray 2 feeds the sheet 11 one by one to the transport section. Then, the sheet 11 is guided by the guide 16, and transported to the space between the counter roller 17 and transport belt 15. Then, the sheet 11 is guided by the transport guide 18 and pressed to the transport belt 15 by the pressure roller 20.

During such sheet transportation, a control circuit (not shown) supplies a positive voltage and negative voltage current to the charge roller 21 from a high voltage power source (not shown) alternately. Therefore, the transport belt 15 is alternately charged with positive voltage and negative voltage, thereby positive voltage charged areas and negative voltage charged areas are formed on the transport belt 15 alternately.

When the sheet 11 is fed on such charged transport belt 15, the sheet 11 is electrostatically adhered on the transport belt 15, and is transported to the recording section with a traveling of the transport belt 15.

The carriage 35 having the recording head 14 can be moved in a direction shown by an arrow B over the sheet 11.

The recording head 14 moving with the carriage 35 discharges droplet (e.g., ink droplet) onto the sheet 11 to record one line image on the sheet 11.

The transportation of the sheet 11 is stopped when recording one line image on the sheet 11.

When the recording of one line image completes, the sheet 11 is transported for a predetermined length and another one line image is recorded on the sheet 11 by discharging droplet (e.g., ink droplet) onto the sheet 11. Such recording is repeated for one page.

When the above-described recording completes for one page, the sheet 11 is ejected to the ejection tray 3.

During a standby mode of the image forming apparatus 1, at which recording is not conducted, the carriage 35 is moved over the refreshing unit 42. During such standby mode, the capping member 43 caps the recording head 14 to maintain the nozzle at a wet condition. By capping the recording head 14 with the capping member 43, discharge malfunction caused by dried nozzle can be prevented.

Furthermore, a refreshing operation such as ejection of viscosity-increased ink and gas bubble from the nozzle can be conducted by suctioning the ink from the nozzle while capping the recording head 14 with the capping member 43.

Furthermore, a dummy discharging operation, in which ink is discharged from the nozzle while actual recording is not conducted, can be conducted before starting the recording operation or during recording operation. With such dummy discharging operation, discharge-ability of the recording head 14 can be maintained at a stable level.

Hereinafter, a configuration of the fuel cell unit 100 having the water supply unit 200 is explained with reference to FIG. 4.

The fuel cell unit 100 can use a fuel made of methanol, for example. Specifically, the fuel cell unit 100 includes a DMFC (direct methanol fuel cell), for example.

A fuel cell can use liquid fuel or hydrogen as fuel. However, hydrogen fuel requires a high-pressure container to store fuel, and thereby hydrogen fuel may not be suitable for the image forming apparatus 1.

Therefore, the image forming apparatus 1 is preferably provided with a DMFC using liquid fuel such as methanol, which is easy to handle.

The DMFC includes an active type cell and a passive type cell.

The active type cell uses a pump and fan to supply or circulate fuel such as methanol and air (or oxygen) to a fuel cell. Although the active type cell has a complex configuration, greater electric power can be easily generated.

The passive type cell uses convection or concentration gradient to supply fuel and air to a fuel cell. Although the passive type cell has a simpler and smaller configuration, electric power generated by the fuel cell is relatively small, and fuel cartridge may tend to become larger because of using a diluted fuel.

Although the image forming apparatus 1 according to an exemplary embodiment can use either type of fuel cell, the image forming apparatus 1 using the active type cell is explained hereinafter because the active type cell is preferred for generating electric, power for the image forming apparatus 1.

Figure 4:
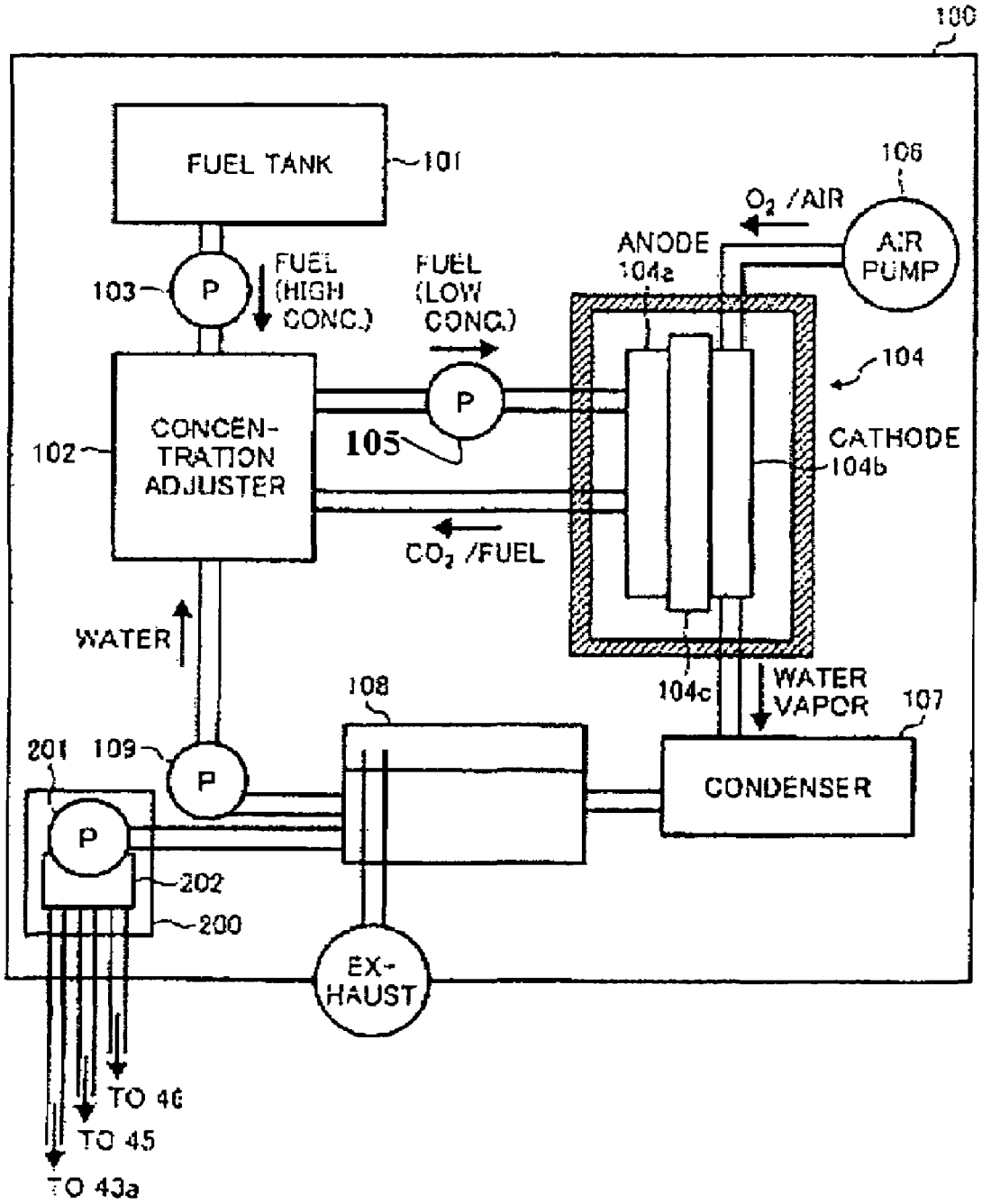
FIG. 4 is a schematic configuration of a fuel cell unit and a water supply unit in an image forming apparatus of FIG. 1.

As shown in FIG. 4, the fuel cell unit 100 includes a fuel tank 101, a concentration adjuster 102, a feed pump 103, a fuel cell stack 104 coated with heat insulating materials, a feed pump 105, an air pump 106, a condenser 107, a water tank 108, a feed pump 109, and a water supply unit 200.

The fuel tank 101 stores liquid fuel such as high concentration methanol.

The fuel tank 101 is connected to the concentration adjuster 102, and the fuel (i.e., methanol) is supplied from the fuel tank 101 to the concentration adjuster 102 by the feed pump 103.

The fuel (i.e., methanol) in the concentration adjuster 102 is diluted to a predetermined concentration with water (i.e., solvent) returned from the fuel cell stack 104.

The concentration adjuster 102 is connected to the feed pump 105. The feed pump 105 supplies methanol, diluted in the concentration adjuster 102, to an anode 104*a* of the fuel cell stack 104 through a feed tube.

In general, diluted methanol is stored in the concentration adjuster 102 in advance as initial condition.

Furthermore, the air pump 106 supplies air to a cathode 104*b* of the fuel cell stack 104 through an air tube.

The methanol and air supplied into the fuel cell stack 104 react with each other at an electrolyte membrane 104*c* provided between the anode 104*a* and cathode 104*b*, and electric power is generated between the anode 104*a* and cathode 104*b*.

During the reaction, carbon dioxide is generated at the anode 104*a*, and water is generated at the cathode 104*b*.

Carbon dioxide generated at the anode 104*a* is guided to the concentration adjuster 102 through an ejection tube connecting the fuel cell stack 104 and the concentration adjuster 102.

Water generated at the cathode 104*b* is guided to the condenser 107 as water vapor through an ejection tube connecting the fuel cell stack 104 and the condenser 107. The water vapor is cooled to liquid in the condenser 107, and the cooled liquid is stored in the water tank 108.

The feed pump 109 supplies water from the water tank 108 to the concentration adjuster 102, as required, to dilute methanol to a predetermined concentration.

The water tank 108 has another ejection tube through which gas such as some air supplied to the cathode 104*b* is ejected to an outside of the fuel cell unit 100.

The water supply unit 200 in the fuel cell unit 100 includes a pump 201, and a switching unit 202 as shown in FIG. 4.

The pump 201 feeds water, received from the water tank 108, to the switching unit 202 while regulating a water amount for feeding.

The switching unit 202 is used to switch water-supply route among the capping member 43 of the refreshing unit 42, the first dummy discharge receiver 45, and the wiper cleaner 46.

The water tank 108 includes a water absorber, by which water may not spillover from the image forming apparatus 1 when moving the image forming apparatus 1, and water generated in the fuel cell unit 100 can be effectively stored in the water tank 108.

The pump 201 includes a tube pump, which generates negative pressure. By controlling tube pump condition such as rotation speed and time, the pump 201 can receive water from the water tank 108 by controlling water amount.

The switching unit 202 can supply a suitable amount of water to each water-supply route to the capping member 43 of the refreshing unit 42, first dummy discharge receiver 45, and wiper cleaner 46.

Such water supply is preferably conducted at a time of before drying and sticking of ink, and thus the ink removing efficiency can be improved.

A water amount required for removing ink from the nozzle changes because drying and sticking condition of ink changes depending on environment condition (e.g., temperature, humidity, etc.) of the image forming apparatus 1.

In order to use the waste ink processing unit 300 for a longer period of time, it is preferable to use a smaller amount of water for cleaning the nozzle.

Hereinafter, a process of supplying water generated in the fuel cell unit 100 to the refreshing unit 42 by the water supply unit 200 is explained with reference to FIGS. 5 and 6.

Figure 6:
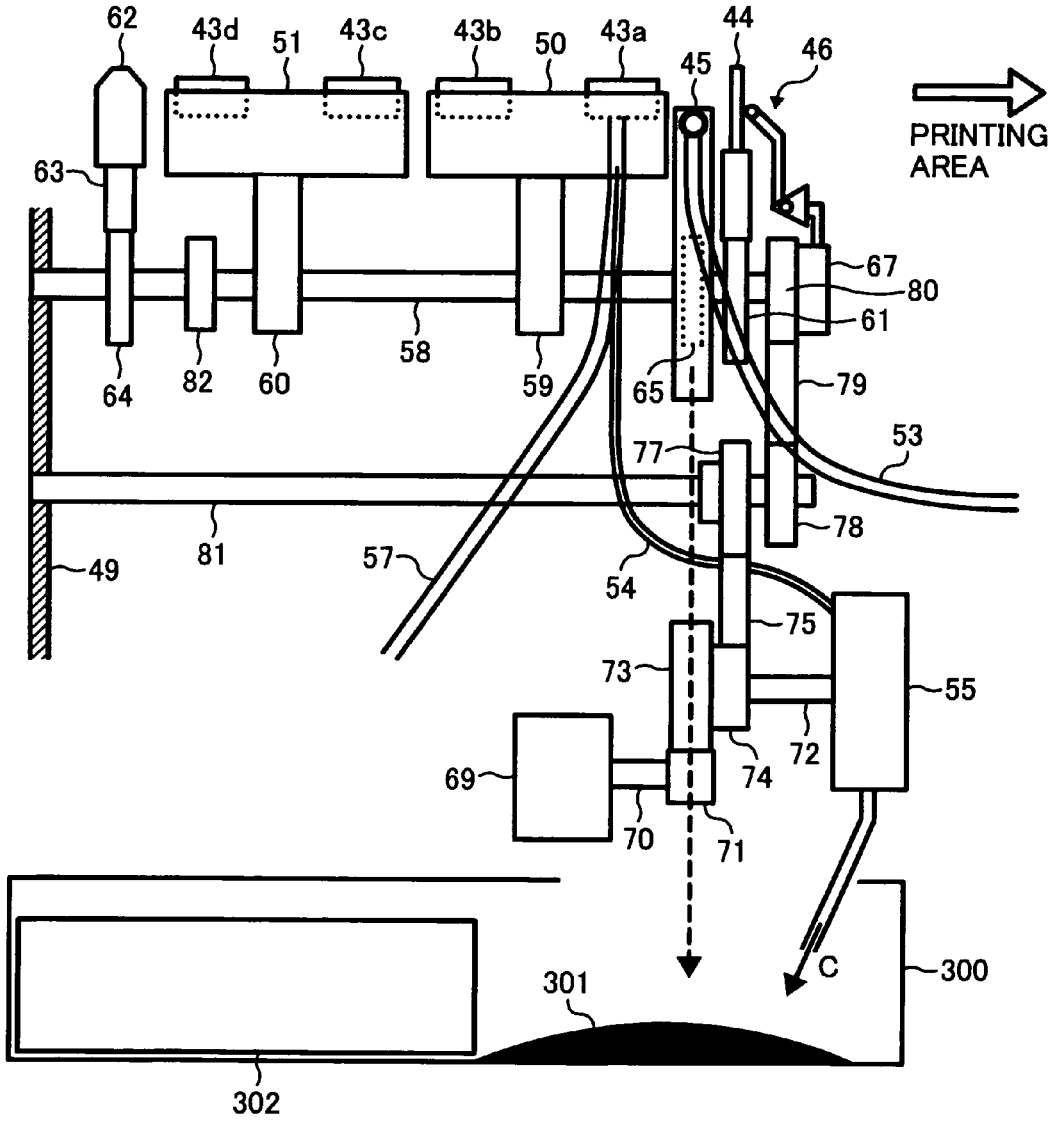
FIG. 6 is a schematic configuration of a refreshing unit, a waste ink processing unit, and a driving mechanism for a refreshing unit in an image forming apparatus of FIG. 1.

As shown in FIG. 6, the refreshing unit 42 has a frame 49 and cap holders 50 and 51. The cap holders 50 and 51, the wiping blade 44, and a carriage lock 62 can be lifted and displaced downwards in a vertical direction as described infra.

The cap holders 50 and 51 can be used as capping device. The wiping blade 44 includes an elastic member for cleaning the nozzle.

Figure 5:
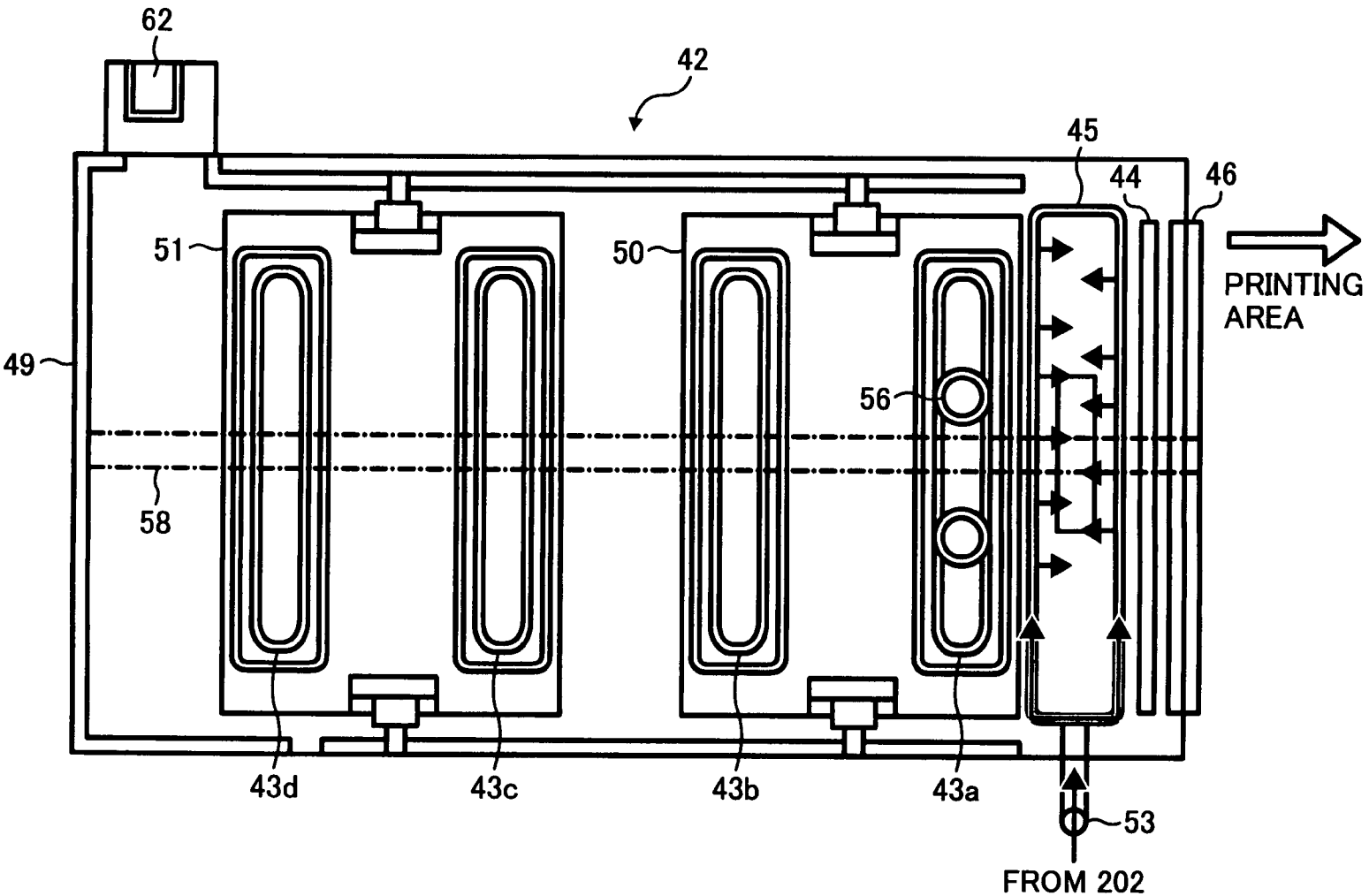
FIG. 5 is a plan view of a refreshing unit in an image forming apparatus of FIG. 1.

As shown in FIG. 5, the first dummy discharge receiver 45 is provided between the wiping blade 44 and the cap holder 50.

A cleaning roller (not shown) is provided to the refreshing unit 42, wherein the cleaning roller (not shown) is used to press the wiping blade 44 to the wiper cleaner 46 when cleaning the wiping blade 44.

The first dummy discharge receiver 45 includes a hollow member, which is connected to the switching unit 202 of the water supply unit 200 via a tube 53 (FIG. 6).

Water supplied to the first dummy discharge receiver 45 can flow into the hollow member in a direction shown by an arrow shown in FIG. 5, which indicates water flow direction. As shown in FIG. 5, water can be supplied from a peripheral area to an inner area of the first dummy discharge receiver 45.

The first dummy discharge receiver 45 may accumulate ink in the hollow member after a dummy discharging operation or when the wiping blade 44 is cleaned (i.e., ink may drop from the wiping blade 44).

With the above-mentioned water flow configuration for the first dummy discharge receiver 45, ink remaining in the first dummy discharge receiver 45 can be removed with water.

Water supply to the first dummy discharge receiver 45 is preferably conducted at a time after dummy discharging operation or after cleaning the wiping blade 44, by which ink removing efficiency can be improved.

In the downward of the refreshing unit 42, a waste ink processing unit 300 (to be described later) is provided, and water drained from the first dummy discharge receiver 45 is guided to the waste ink processing unit 300.

Each of the cap holders 50 and 51 includes two cap members as shown in FIGS. 5 and 6.

The cap holder 50 includes capping members 43*a* and 43*b*, and the cap holder 51 includes capping members 43*c* and 43*d* for capping the nozzle face of the recording head 14.

As shown in FIG. 6, among the capping members 43*a*, 43*b*, 43*c*, and 43*d*, the capping member 43*a* is closest to a printing area where a printing is conducted in the image forming apparatus 1.

As shown in FIG. 6, the capping member 43*a* is connected to a tubing pump 55 via a flexible tube 54, wherein the tubing pump 55 functions as suctioning unit, while other capping members 43*b*, 43*c*, and 43*d* are not connected to the tubing pump 55.

Accordingly, the capping member 43*a* is a moisture retention capping member having suctioning function, and other capping members 43*b*, 43*c*, and 43*d* are moisture retention capping members having no suctioning function.

Therefore, when conducting a refreshing operation to the recording head 14, the to-be-refreshed recording head 14 is moved to a position where the recording head 14 can face the capping member 43*a* so that the to-be-refreshed recording head 14 can be capped by the capping member 43*a* having suctioning function.

As shown in FIGS. 5 and 6, the capping member 43*a* includes a supply hole 56, which is connected to the switching unit 202 of the water supply unit 200 via a tube 57.

When a refreshing operation of the recording head 14 is conducted with the capping member 43*a*, ink suctioning is conducted by the tubing pump 55 for refreshing the recording head 14, and as a result, some ink may remain in the capping member 43*a*.

After such ink suctioning operation, water may be supplied to the recording head 14 from the supply hole 56 before the remained ink is dried or sticks on the recording head 14. Then, the tubing pump 55 can drain such water from the capping member 43*a*, and as a result, the remained ink can be removed from the capping member 43*a*.

The tubing pump 55 drains water from the capping member 43*a* to the waste ink processing unit 300 in a direction shown by arrow C in FIG. 6.

In order to use the waste ink processing unit 300 with a longer period of time, it is preferable to use a smaller amount of water for cleaning the nozzle.

An amount of water supply to the capping member 43*a* can be determined by considering following conditions.

First, in case of removing ink from the capping member 43*a*, water supply may not be required for each time a refreshing operation is conducted with the capping member 43*a*. For example, even if some ink remains in the capping member 43*a*, such ink may be removed by supplying water to the capping member 43*a* at a predetermined timing. With such process, ink remaining in the capping member 43*a* can be swelled or dispersed with water.

Secondly, if ink remaining in the capping member 43*a* is dried and sticks, the nozzle face may be blocked by such ink. If water can be supplied to the ink remaining in the capping member 43*a* before the capping member 43*a* caps the recording head 14 for capping the recording head 14 for some time, the ink in the capping member 43*a* can be swelled or dispersed with water, and thus above-mentioned ink drying and sticking problem may not happen.

Thirdly, in a normal operating condition, dried and stuck ink accumulated in the first dummy discharge receiver 45 may drop to the waste ink processing unit 300 due to its own weight, and the dropped ink becomes a waste ink 301. In general, the waste ink 301 is less likely to be absorbed by an absorber 302 provided in the waste ink processing unit 300. The waste ink 301 may accumulate to a larger volume under some printing conditions and may spillover from the waste ink processing unit 300. However, if water is supplied to the waste ink 301, the waste ink 301 may be swelled or dispersed with water, by which the waste ink 301 is more likely to be absorbed by the absorber 302, and thereby the above-mentioned problem such as spillover may not happen.

By considering the above-mentioned conditions, water supply to the first dummy discharge receiver 45 may not be required for each time the dummy discharging operation is conducted, and thereby a frequency of water supply can be made smaller. The frequency of water supply can be determined by considering the above-mentioned conditions and a cleaning-ability of the wiping blade 44 and wiper cleaner 46.

As shown in FIG. 6, a cam shaft 58 is provided under the cap holders 50 and 51, wherein the cam shaft 58 is rotatably supported by the frame 49.

As shown in FIG. 6, two cap cams 59 and 60, a wiper cam 61, a carriage lock cam 64, a roller 65, and a cleaner cam 67 are attached to the cam shaft 58.

The cap cams 59 and 60 are used to lift and down the cap holder 50 and 51. The wiper cam 61 is used to lift and down the wiping blade 44. The carriage lock cam 64 is used to lift and down a carriage lock 62 with a carriage lock arm 63.

When a dummy discharge is conducted with the first dummy discharge receiver 45, droplets, which drop from the first dummy discharge receiver 45, may impact the roller 65. The cleaner cam 67, driven by the cam shaft 58, lifts and downs the wiper cleaner 46.

With such configuration, the capping member 43 in the cap holders 50 and 51 can be lifted and downed by the cap cams 59 and 60.

The wiping blade 44 can be lifted and downed by the wiper cam 61. When the wiping blade 44 is downed, the wiper cleaner 46 relatively moves in an upward of the wiping blade 44. When the wiping blade 44 is downed while receiving wiping effect of the wiper cleaner 46, ink adhered on the wiping blade 44 can be scraped by the wiper cleaner 46, and such scraped ink may drop in the first dummy discharge receiver 45.

The carriage lock 62 is biased to an upward direction (lock direction) by a spring (not shown), and can be lifted and downed by the carriage lock cam 64 with the carriage lock arm 63.

Figure 7:
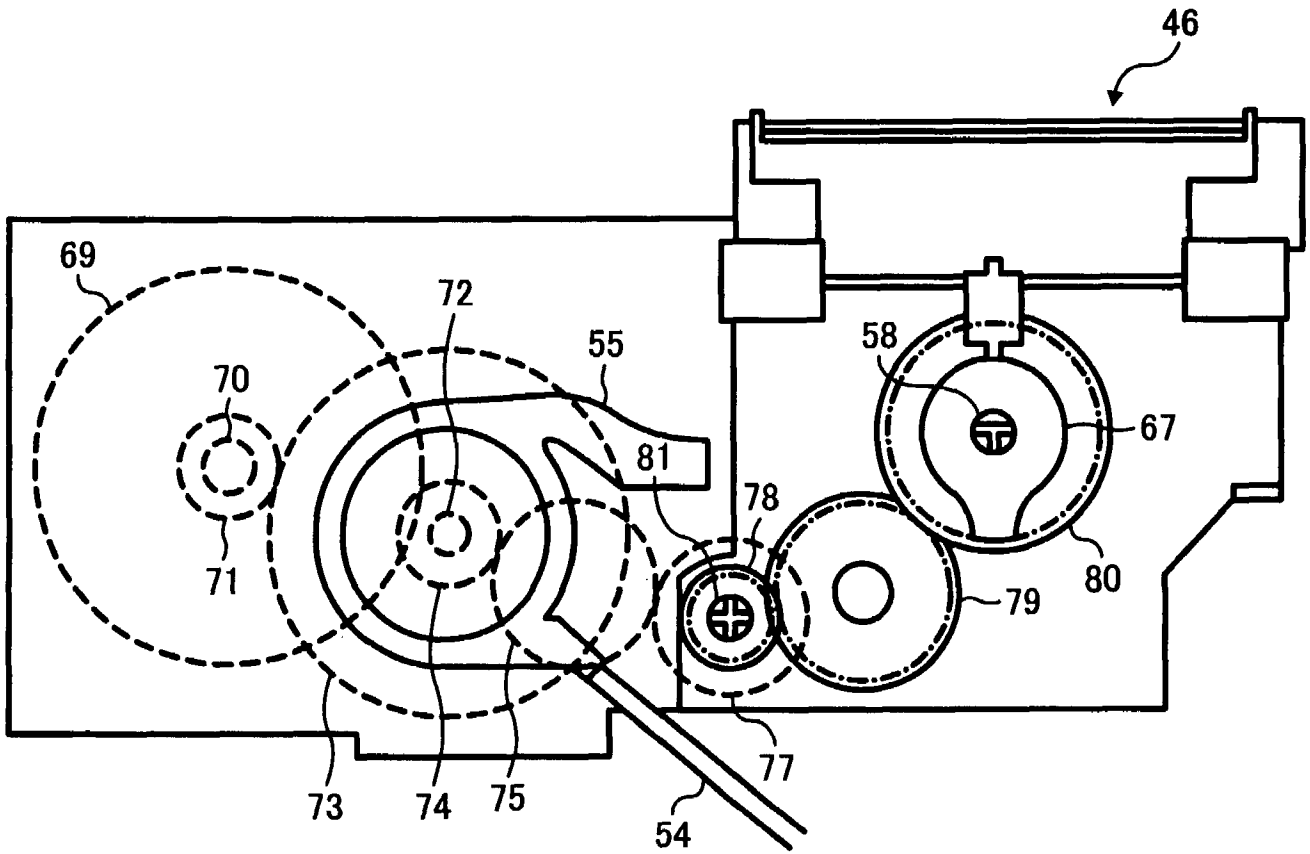
FIG. 7 is a schematic view explaining an arrangement of driving mechanism for a refreshing unit in an image forming apparatus of FIG. 1.

FIG. 7 is a schematic configuration of driving mechanism for driving the tubing pump 55 and cam shaft 58.

As shown in FIGS. 6 and 7, a motor shaft 70 of a motor 69 is connected to a motor gear 71, and a pump shaft 72 of the tubing pump 55 is connected to a pump gear 73.

As shown in FIGS. 6 and 7, the motor gear 71 and pump gear 73 is meshed with each other. The pump gear 73 is integrated with an intermediate gear 74. The intermediate gear 74 is meshed to an intermediate gear 75.

The intermediate gear 75 is meshed to an intermediate gear 77 having one-direction clutch (not shown), and the intermediate gear 77 is co-axially connected to an intermediate gear 78 with a shaft 81, wherein the shaft 81 is rotatably supported by the frame 49 as shown in FIG. 6.

The intermediate gear 78 is meshed to an intermediate gear 79, and the intermediate gear 79 is meshed to a cam gear 80, which is connected to the cam shaft 58 as shown in FIGS. 6 and 7.

Furthermore, the refreshing unit 42 also includes a home position sensor (not shown), a home position lever (not shown), and a cam 82 for detecting a home position for units in the refreshing unit 42 when to activate the unit in the refreshing unit 42.

In the image forming apparatus 1 according to an exemplary embodiment, ink remained in the capping unit can be efficiently cleaned, and thereby the remaining ink can be removed from the capping unit.

Furthermore, in the image forming apparatus 1 according to an exemplary embodiment, after conducting an ink suctioning operation, water can be supplied to the capping unit, and such water is sucked by another suctioning operation, and thus remaining ink can be efficiently cleaned, and thereby the remaining ink be removed from the capping unit.

Furthermore, in the image forming apparatus 1 according to an exemplary embodiment, by supplying water to the capping unit before capping the recording head, ink remaining on the recording head may become fluid through such water supply, and thus a nozzle blocking can be prevented.

Furthermore, in the image forming apparatus 1 according to an exemplary embodiment, after conducting a dummy discharging operation, water can be supplied to the dummy discharge receiver to efficiently remove ink remained in the dummy discharge receiver.

Furthermore, in the image forming apparatus 1 according to an exemplary embodiment, by supplying water to the waste ink processing unit at a predetermined timing, the waste ink processing unit can efficiently store the ink therein.

Furthermore, in the image forming apparatus 1 according to an exemplary embodiment, the capping member, the dummy discharge receiver, and the waste ink processing unit may accumulate ink at least temporarily when the above-described cleaning operation for the recording head is conducted.

It should be understood that the term "ink accumulation area" is used broadly herein to include any of the regions where ink may dry or coagulate in an image forming apparatus, and this disclosure merely provides some examples of such locations.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments and/or examples may be combined with each other and/or substituted for each other within the scope of this disclosure and appended claims.

This application claims priority from Japanese patent application No. 2005-170495 filed on Jun. 10, 2005 in the Japan Patent Office, the entire contents of which is hereby incorporated by reference herein.

What is claimed is:

1. An image forming apparatus having a recording head for discharging ink and a refreshing unit configured to maintain nozzle condition of the recording head, said image forming apparatus further comprising:

a fuel cell unit configured to generate power for the image forming apparatus and to generate water when the power is generated in the fuel cell unit;

a water supply unit configured to supply the water, generated by the fuel cell unit, to an ink accumulation area in the image forming apparatus, wherein ink remaining on the refreshing unit is removed by the water generated by the fuel cell unit.

2. The image forming apparatus according to claim 1, further comprising a waste ink processing unit, wherein said refreshing unit and said waste ink processing unit are in the ink accumulation area.

3. The image forming apparatus according to claim 2, wherein the waste ink processing unit stores waste ink, and the waste ink is supplied with the water from the water supply unit.

4. The image forming apparatus according to claim 3, wherein the water supply unit supplies the water to the waste ink processing unit, before the waste ink is dried and stuck in the waste ink processing unit.

5. The image forming apparatus according to claim 3, wherein the water supply unit supplies water to the waste ink processing unit, after a dummy discharging operation is conducted with the recording head and the refreshing unit.

6. The image forming apparatus according to claim 1, wherein the water generated by the fuel cell is supplied to the refreshing unit which refreshes the recording head to maintain recording quality of the recording head, using the water supplied from the water supply unit.

7. The image forming apparatus according to claim 6, wherein the refreshing unit comprises a capping unit configured to cap a discharge face of the recording bead to suck the ink from the discharge face, and the capping unit is supplied with the water from the water supply unit.

8. The image forming apparatus according to claim 7, wherein the water supply unit supplies water to the capping unit, before the ink is dried and stuck in the capping unit.

9. The image forming apparatus according to claim 7, wherein the capping unit conducts an ink suctioning operation to the recording head, after the water is supplied to the capping unit from the water supply unit.

10. The image forming apparatus according to claim 7, wherein the capping unit conducts a first ink suctioning operation to the recording head, before the water is supplied to the capping unit from the water supply unit, and conducts a second ink suctioning operation to the recording head, after the water is supplied to the capping unit from the water supply unit.

11. The image forming apparatus according to claim 7, wherein the water supply unit supplies water to the capping unit, before the capping unit caps the recording head.

12. The image forming apparatus according to claim 1, wherein the water supply unit comprises art adjusting unit configured to adjust an amount of the water to be supplied to the ink accumulation area.

13. The image forming apparatus according to claim 12, wherein the adjusting unit adjusts the amount of the water to be supplied to the ink accumulation area depending an environmental conditions including temperature and humidity.

14. The image forming apparatus of claim 1, further comprising a switching unit, wherein said switching unit switches a route of supply of the water to one or more of a plurality of locations in the image forming apparatus.

15. The image forming apparatus of claim 14, wherein said switching unit controls a quantity of the water supplied to the one or more locations.

16. The image forming apparatus according to claim 1, wherein the water supply unit supplies at least some of the water generated by the fuel cell unit to a nozzle of the recording head for cleaning ink remaining on or in the nozzle.

17. A method for maintaining an ink delivery path in an image forming apparatus having a recording head and a refreshing unit configured to maintain nozzle condition of the recording head, said method comprising:

(a) collecting water generated by a fuel cell unit of the image forming apparatus; and (b) supplying the water collected in (a) to an ink accumulation area in the forming apparatus; and removing ink remaining on the refreshing unit by utilizing the water generated by the fuel cell unit.

18. An image forming apparatus having a recording head for discharging ink and a waste ink processing unit configured to accumulate Waste ink, said image forming apparatus further comprising:

a fuel cell unit configured to generate power for the image forming apparatus and to generate water when the power is generated in the fuel cell unit;

a water supply unit configured to supply the water, generated by the fuel cell unit, to an ink accumulation area in the image forming apparatus, wherein the waste ink accumulated in the waste ink processing unit is swelled and flattened by the water generated by the fuel cell unit.

19. The image forming apparatus according to claim 18, wherein the water supply unit comprises an adjusting unit configured to adjust an amount of the water to be supplied to the ink accumulation area.

20. The image forming apparatus according to claim 19, wherein the adjusting unit adjusts the amount of the water to be supplied to the ink accumulation area depending on environmental conditions including temperature and humidity.

* * * * *